United States Patent [19]

Boswel

[11] Patent Number: 4,628,654

[45] Date of Patent: Dec. 16, 1986

[54] COMPOSITE FLOOR STRUCTURES

[75] Inventor: Justus A. T. Boswel, Pretoria, South Africa

[73] Assignee: Wesmer Konstruksie (Eiedoms) Beperk, Pretoria, South Africa

[21] Appl. No.: 533,761

[22] Filed: Sep. 19, 1983

[30] Foreign Application Priority Data

| | | | |
|---|---|---|---|
| Sep. 20, 1982 | [ZA] | South Africa | 82/6886 |
| Nov. 22, 1982 | [ZA] | South Africa | 82/8590 |
| Mar. 22, 1983 | [ZA] | South Africa | 83/1994 |

[51] Int. Cl.[4] ..... E04B 5/18

[52] U.S. Cl. ..... 52/319; 52/340; 52/333

[58] Field of Search ..... 52/483, 490, 491, 220, 52/221, 319–341, 368, 376

[56] References Cited

U.S. PATENT DOCUMENTS

| | | | |
|---|---|---|---|
| 681,969 | 9/1901 | O'Neil | 52/330 |
| 775,927 | 11/1904 | Kahn | 52/336 |
| 1,014,157 | 1/1912 | Lewen | 52/326 |
| 1,086,343 | 2/1914 | Anderson | 52/340 |
| 1,220,915 | 3/1917 | Wells | 52/326 |
| 2,167,208 | 7/1939 | Hilpert | 52/333 |
| 2,233,291 | 2/1941 | Keebov | 52/335 |
| 3,108,662 | 10/1963 | Schick | 52/335 |
| 3,307,304 | 3/1967 | Klausner | 52/326 |
| 3,336,708 | 8/1967 | Rambelle | 52/376 |
| 3,528,209 | 9/1979 | Schillinger | 52/368 |
| 3,624,980 | 12/1971 | McManus | 52/327 |
| 3,812,636 | 5/1974 | Albrecht et al. | 52/334 |

FOREIGN PATENT DOCUMENTS

| | | | |
|---|---|---|---|
| 301821 | 9/1972 | Austria . | |
| 349708 | 4/1979 | Austria . | |
| 927758 | 6/1973 | Canada | 52/221 |
| 1649662 | 12/1952 | Fed. Rep. of Germany . | |
| 7145511 | 4/1972 | Fed. Rep. of Germany . | |
| 2521143 | 11/1976 | Fed. Rep. of Germany . | |
| 2600662 | 7/1977 | Fed. Rep. of Germany . | |
| 3000716 | 9/1980 | Fed. Rep. of Germany . | |
| 3028046 | 2/1982 | Fed. Rep. of Germany . | |
| 3105889 | 11/1982 | Fed. Rep. of Germany | 52/319 |
| 1253272 | 1/1961 | France . | |
| 626466 | 10/1961 | Italy | 52/323 |
| 425581 | 8/1936 | United Kingdom | 52/319 |
| 2060730 | 5/1981 | United Kingdom . | |

OTHER PUBLICATIONS

R. P. Johnson, "Composite Structures of Steel and Concrete", vol. 1, pp. 26, 27 and 62, dated 1975.

*Primary Examiner*—John E. Murtagh
*Assistant Examiner*—Andrew Joseph Rudy
*Attorney, Agent, or Firm*—Finnegan, Henderson, Farabow, Garrett & Dunner

[57] ABSTRACT

A composite floor structure comprising a floor slab of concrete or other compression resistant material; and at least one reinforced beam under the floor slab. The beam comprises permanent shuttering including an open-mouthed, upwardly facing channel formation of steel or other tension resistant material; and a plurality of transverse members spaced apart along the length of the channel formation and extending transversely to the channel formation across substantially the entire width of the mouth of the channel formation. Each transverse member is fast with the channel formation in the region of its mouth on opposite sides of the mouth and at least part of at least certain of the transverse members extend upwardly from the region of the mouth of the channel formation into the overlying floor slab. Concrete or other compression resistant material is located in the channel formation and is formed integrally with the compression resistant material of the floor slab.

10 Claims, 5 Drawing Figures

COMPOSITE FLOOR STRUCTURES

This invention relates to composite floor structures.

It is known from U.S. Pat. Nos. 775,927 and 3,812,636 to provide so-called composite reinforced concrete floor structures comprising permanent metal shuttering which not only supports the concrete of the structure while it is still wet and unhardened but which also constitutes the permanent tension resistant reinforcing component in the structure; and concrete in and/or on the shuttering which constitutes the compression resistant component of the structure. In order to achieve composite load carrying capability, means is provided to resist vertical disengagement of the concrete from the metal and also to resist relative horizontal shear movement between the concrete and the metal.

U.S. Pat. No. 775,927 discloses an arrangement in which a corrugated metal shuttering plate is provided with a series of so-called "auxiliary tension members" which are fast with the shuttering plate and extend upwardly at an angle to the vertical from the bottoms of the corrugations to above the crests of the corrugations.

By pouring concrete into the corrugations to fill the corrugations and form a layer above the crests of the corrugations, a concrete floor slab with a series of transversely spaced reinforced beams located under the slab may be obtained in which the auxiliary tension members extend upwardly from the bottom of the beams into the floor slab. The auxiliary tension members present surfaces facing longitudinally relative to the beams and act as shear-resisting means for resisting relative horizontal movement between the concrete and the metal shuttering. Since the auxiliary tension members extend upwardly at an angle to the vertical they also act as hold-down elements to resist vertical disengagement of the concrete from the metal shuttering.

The arrangement of U.S. Pat. No. 775,927 suffers from the disadvantage that the shear-resisting effect of the auxiliary tension members is inadequate for a full utilisation of the structural capabilities of the concrete and the metal shuttering plate and also that the torsion resistance of the composite structure is not as high as may be desired. Furthermore, as the auxiliary tension members are located at angles to the vertical, horizontal shear forces acting on the upwardly facing surfaces of the auxiliary tension members produce downward components of force on the concrete underneath the auxiliary tension members. Such downward components of force tend to break away parts of the concrete located underneath the auxiliary tension members.

U.S. Pat. No. 3,812,636 discloses a corrugated sheet metal decking unit for a composite floor structure which presents hold-down elements above and below the geometric mid-plane of the unit and which also presents shear-resisting elements below the geometric mid-plane. The hold-down elements above the geometric mid-plane comprise rows of inwardly directed, longitudinally spaced deformations which are integrally formed in sloping webs of beam-defining corrugations of the unit and which are of such a nature that they may also serve to resist horizontal shear movement between the concrete and the metal. The hold-down elements below the geometric mid-plane comprise inwardly directed ribs extending longitudinally along beam defining corrugations of the unit in positions in or near valley or base regions of the corrugations. The shear resisting means comprises a series of longitudinally spaced, upwardly directed deformations in valley or base regions of the corrugations. These shear resisting deformations do not extend into the region of a floor swab overlying the decking unit. In addition, U.S. Pat. No. 3,812,636 discloses the use of so-called shear connectors in the form of studs with heads thereon which are welded to beams supporting the decking unit and which extend into the floor slab overlying the decking unit.

The arrangement of U.S. Pat. No. 3,812,636 also suffers from the disadvantages that the shear resistance is inadequate for a full utilization of the structural capabilities of the concrete and the metal decking unit and that the torsion resistance of the composite structure is not as high as may be desired.

It is also known to provide a composite floor structure comprising a concrete floor slab with a plurality of transversely spaced reinforced concrete beams under the slab, in which a metal I-beam extends longitudinally along each reinforced beam with the web of the I-beam disposed vertically and the upper flange of the I-beam embedded in the concrete of the slab above the reinforced beam. With this arrangement the upper flange of the I-beam acts as hold-down means to resist vertical disengagement of the concrete and the metal.

The I-beam would not normally present shear-resisting surfaces facing longitudinally along the reinforced beam, but it is known to secure to the upper flanges of such an I-beam a series of vertically disposed, longitudinally facing shear resisting metal members which are disposed transversely to the I-beam and are spaced longitudinally therealong. Such metal members may include horizontally disposed hold-down formations which are spaced upwardly from the upper flanges of the I-beam.

The arrangement of the previous paragraph may provide adequate longitudinal shear resistance but suffers from the disadvantage that with an I-beam a relatively large mass of metal is required to provide a given moment of resistance to vertical bending. This results in a relatively heavy and expensive beam structure.

It is an object of the present invention to provide improved composite floor structures with which the above disadvantages are avoided or at least minimized.

According to the invention a composite floor structure comprises a floor slab of compression resistant material; and at least one reinforced beam under the floor slab, the beam comprising:

permanent shuttering including an open-mouthed, upwardly facing channel formation of tension resistant material; and a plurality of transverse members spaced apart along the length of the channel formation and extending transversely to the channel formation across substantially the entire width of the mouth of the channel formation, each transverse member being fast with the channel formation in the region of its mouth on opposite sides of the mouth and at least part of at least certain of the transverse members extending upwardly from the region of the mouth of the channel formation into the overlying floor slab; and compression resistant material located in the channel formation and formed integrally with the compression resistant material of the floor slab.

Preferably, the transverse members or the parts thereof which extend upwardly into the overlying floor slab are disposed substantially vertically.

The term "permanent shuttering" is used in this specification to signify means which is adapted to support the compression resistant material of a reinforced beam, with or without the aid of additional temporary support means and/or shuttering, while the compression resistant material is still in a fluid and unset or unhardened condition and also to constitute permanent reinforcement for the compression resistant material after the latter has set or hardened.

Any suitable compression resistant material may be used. The compression resistant material may comprise conventional concrete; foamed concrete; so-called "no-fines" concrete; a composition including cement and polystyrene such as that which is sold under the trade name "STYROCRETE"; a suitable compression resistant synthetic resinous composition; or any other suitable settable or hardenable composition adapted to be introduced into the channel formation in a fluid state.

The channel formation may comprise any suitable tension resistant material, such as a suitable metal or a suitable synthetic resinous material. The transverse members may comprise the same material as the channel formation. Preferably, the channel formation and the transverse members comprise steel.

With the arrangement according to the invention at least certain of the transverse members constitute shear resisting members presenting compression resistant material engaging surfaces which face longitudinally along the channel formation and extend upwardly into the floor slab from the region of the mouth of the channel. A positive mechanical integration between the compression resistant material and the tension resistant material of the structure and an enhanced resistance to relative horizontal shear movement between the compression and tension resistant materials may be obtained.

Preferably, at least certain of the transverse members extend upwardly into the floor slab across the entire width of the mouth of the channel formation.

The transverse members may also present surfaces serving as hold-down means to resist vertical separation of the compression and tension resistant material.

The transverse members may have any suitable cross-sectional configuration, such as angle section.

The transverse members also serve as brace members tying the upright sides of the channel formation together in the region of the open mouth of the channel formation, thereby to retain the upright sides of the channel formation against outward displacement when the compression resistant material is introduced into the channel formation in a fluid condition and also to increase the torsion resistance of the channel formation.

In a preferred embodiment of the invention the permanent shuttering also includes at least one upright member for each of at least certain of the transverse members, each upright member being located within the channel formation and extending upwardly from a position at or near the bottom of the channel formation, each upright member being fast with its own transverse member and with the channel formation.

It will be appreciated that the arrangement of the preceding paragraph provides a plurality of upright members which extend upwardly from positions at or near the bottom of the beam and which are spaced apart along the length of the beam.

The upright members acting in conjunction with the transverse members stiffen the channel formation against bending in a vertical plane.

The upright members may comprise the same material as the channel formation and the transverse members.

The upright members may be of elongate configuration.

Depending on the width of the channel formation each of least certain of the transverse members may be provided with only one upright member or with a set of at least two upright members which are spaced apart transversely to the channel formation.

In a relatively narrow beam each transverse member may be provided with a single upright member which is located between the upright sides of the channel formation or with a set of two upright members which are spaced apart transversely to the channel formation and are located at or near the opposite upright sides of the channel formation.

In a relatively broad beam each transverse member may be provided with a set of two or more upright members which are located in spaced relationship in a row extending transversely to the channel formation.

The outer upright members in each row of upright members may be located at or near the opposite upright sides of the channel formation.

The upright members may have any suitable cross-sectional configuration, such as angle-section.

The channel formation may comprise a single member of integral construction or may comprise a plurality of members of suitable cross-sectional configuration which are suitably connected together.

The channel formation may be adapted to be permanently supported in a least two spaced positions along its length.

The channel formation may also be adapted to support shuttering means for the floor slab.

The upright sides of the channel formation may be provided towards their upper ends with transverse formations which are adapted to support floor shuttering means.

The floor shuttering means may be removable after setting or hardening of the compression resistant material.

Preferably, a composite floor structure according to the invention includes permanent shuttering of tension resistant material for the floor slab, such permanent floor shuttering being adapted to constitute permanent reinforcement for the floor after setting or hardening of the compresison resistant material.

The channel formation may present a suitably located, outwardly directed formation adapted to support an edge of a ceiling panel. Such an outwardly directed formation is preferably located at or near the bottom of the beam.

Any suitable fire protective means may be provided for the tension resistant parts of the beam and/or the floor.

A fire-resistant cladding may be provided adjacent the exposed surfaces of the tension resistant parts of the beam.

The invention also includes within its scope permanent beam shuttering as defined above.

For a clear understanding of the invention preferred embodiments will now be described by way of example with reference to the accompanying drawings in which:

FIG. 1 is a diagrammatic and fragmentary sectional perspective view of a composite reinforced concrete floor structure according to the invention, illustrating one embodiment of permanent beam shuttering according to the invention.

FIG. 2 is a diagrammatic and fragmentary perspective view of another embodiment of a composite reinhorizontal movement between the steel and the concrete in a direction transversely to the beams B1. The flanged upright sides 12*a* of floor shuttering pans 10*a* act as shear resisting means to resist relative horizontal movement between the steel and the concrete in a direction longitudinally along the beams B1 and also act as hold-down means to resist vertical separation of the steel and the concrete.

It will be appreciated that floor slab A1 is fully integrated with each of the beams B1 both in regard to concrete and reinforcing metal. The structure of the steel work is such that the hold-down and shear-resisting characteristics of the steel are relatively insensitive to temperature variations.

With the arrangement according to the invention utilizing a channel formation as the main tension resistant element, a cheaper, lighter and more slender beam may be provided to give a predetermined moment of resistance to bending with a given mass of metal, than is possible with a conventional arrangement utilizing an unencapsulated I-beam or a concrete encapsulated I-beam as the main tension resistant element.

If required the exposed metal surfaces of each beam B1 may be provided with a fire-resistant or fire-protective cladding C. Such cladding C may comprise a preformed slab 14 of concrete or other fire-resistant material with a plurality of transversely extending, longitudinally spaced anchor elements 15 embedded therein. A pair of transversely spaced upright hanger elements 16 is secured, such as by welding, to each anchor element 15 and projects upwardly beyond the upper surface of the slab 14. The hanger elements 16 are secured, such as by welding, to the outer faces of the upright main flanges 3*a* of the channel member 1*a* of the beam B, thereby to suspend the cladding slab 14 from the channel member 1*a* with the upper surface of slab 14 abutting the lower face of the bottom web 2*a* of the channel member 1*a* of the beam B1.

The slab 14 projects transversely to the beam B1 beyond the upright main flanges 3*a* of the channel member 1*a* of the beam B1 to define ledges 14*a* on opposite sides of the beam on which bricks or panels 17 of any suitable kind are lain to provide fire-resistant walls on the outside of the upright main flanges 3*a* of the channel members 1*a*.

The arrangement of FIG. 2 is similar to that of FIG. 1 with the exception that the permanent beam shuttering of FIG. 2 comprises a channel formation 1*b* which is built up from three separate parts instead of comprising a single channel member of integral construction and that the transverse members 5*b* of FIG. 2 comprise flat plates instead of being of angle section.

As shown in FIG. 2, channel formation 1*b* comprises two elongate steel members 18*b* comprising so-called "lipped zed" sections which are spaced apart transversely to the beam B2 and define the upright main flanges 3*b* and the upper outwardly directed secondary flanges 4*b* of the channel formation 1*b*; and an elongate steel member 20*b* which has a plane flat configuration and is welded to the lower inwardly directed flanges 19*b* of the two "lipped zed" members 18*b* to define the bottom web 2*b* of the channel formation 1*b*.

The flat plate-like transverse members 5*a* of steel are spaced apart along the length of channel formation 1*b* and extend transversely to channel formation 1*b* across the entire width of the upwardly facing open mouth of channel formation 1*b*. Each transverse member 5*b* is welded to the upright main flanges 3*b* of channel formation 1*b* at 7*b* on opposite sides of the mouth of the channel formation and each transverse member 5*b* extends forwardly from the mouth of channel formation 1*b* in the direction in which the mouth faces to a position spaced outwardly from the mouth. The outwardly extending transverse members 5*b* are disposed substantially at right angles to the plane containing the mouth of channel formation 1*b*.

Each transverse member 5*b* is provided with an elongate steel upright member 9*b* of angle section which is located within channel formation 1*b* in a position between the upright main flanges 3*b* of channel formation 1*b* and which is welded at opposite ends thereof to its transverse member 5*b* and to flat member 20*b* constituting the bottom web 2*b* of channel formation 1*b*.

The upper outwardly directed secondary flanges 4*b* of a pair of adjacent channel formation 1*b* which are located in transversely spaced relationship to each other, support permanent floor shuttering pans 10*b* which are made of steel. Concrete 11 is poured into floor shuttering pans 10*b* and into the channel formations 1*b* round upright members 9*b* and transverse members 5*b* to form the reinforced concrete floor slab A2 and the integral concrete beam B2. The concrete of floor slab A2 is integral with the concrete in channel formation 1*b*. Upright members 9*b* and transverse members 5*b* are surrounded by concrete. The upright members 9*b* extend upwardly into floor slab A2 and the upper edges of transverse members 5*b* are covered by a layer of concrete.

The upper and lower vertically facing edges 8*b* of the flat plate-like transverse members 5*b* constitute hold-down means to resist vertical separation of the metal and concrete components. The vertically disposed, horizontally facing surfaces 6*b* on opposite sides of the transverse members 5*b* act as shear-resisting means to resist relative horizontal movement between the metal and concrete components.

The arrangement of FIG. 3 is similar to that of FIG. 2 with the exception that instead of the channel formation 1*c* of FIG. 3 being built up from two "lipped zed" sections, channel formation 1*c* is built up from two elongate channel members 18*c* of generally U-shaped cross-sectional configuration which are made of steel and are located with the mouths of the channels facing outwardly in a direction transversely to the beam B3; and an elongate steel member 20*c* which has a plane flat configuration and is welded to the outwardly directed lower flanges 19*c* of the two channel members 18*c*. The steel floor shuttering pans 10*c* rest on the upper outwardly directed secondary flanges 4*c* of the channel members 18*c*.

After the floor structure has been completed, ceiling panels 22*c* may be located on the outwardly directed lower flanges 19*c* of the opposed channel mebers 18*c* of a pair of adjacent beams B3. It will be seen in FIG. 3 that the bottom plate-like member 20*c* of channel formation 1*c* constitutes a cover strip over the gap between the ceiling panels 22*c* located on opposite sides of a beam B3.

The permanent beam shuttering illustrated in FIG. 4 is similar to that of FIG. 1 with the exception that instead of each transverse member 5*d* of FIG. 4 being provided with a single centrally located upright member, each transverse member 5*d* is provided with a pair of elongate upright members 9*d* which extend upwardly from web 2*d* of channel member 1*d* and which are spaced apart transversely to the length of channel memforced concrete floor structure according to the invention, illustrating another embodiment of permanent beam shuttering according to the invention.

Figure 1:
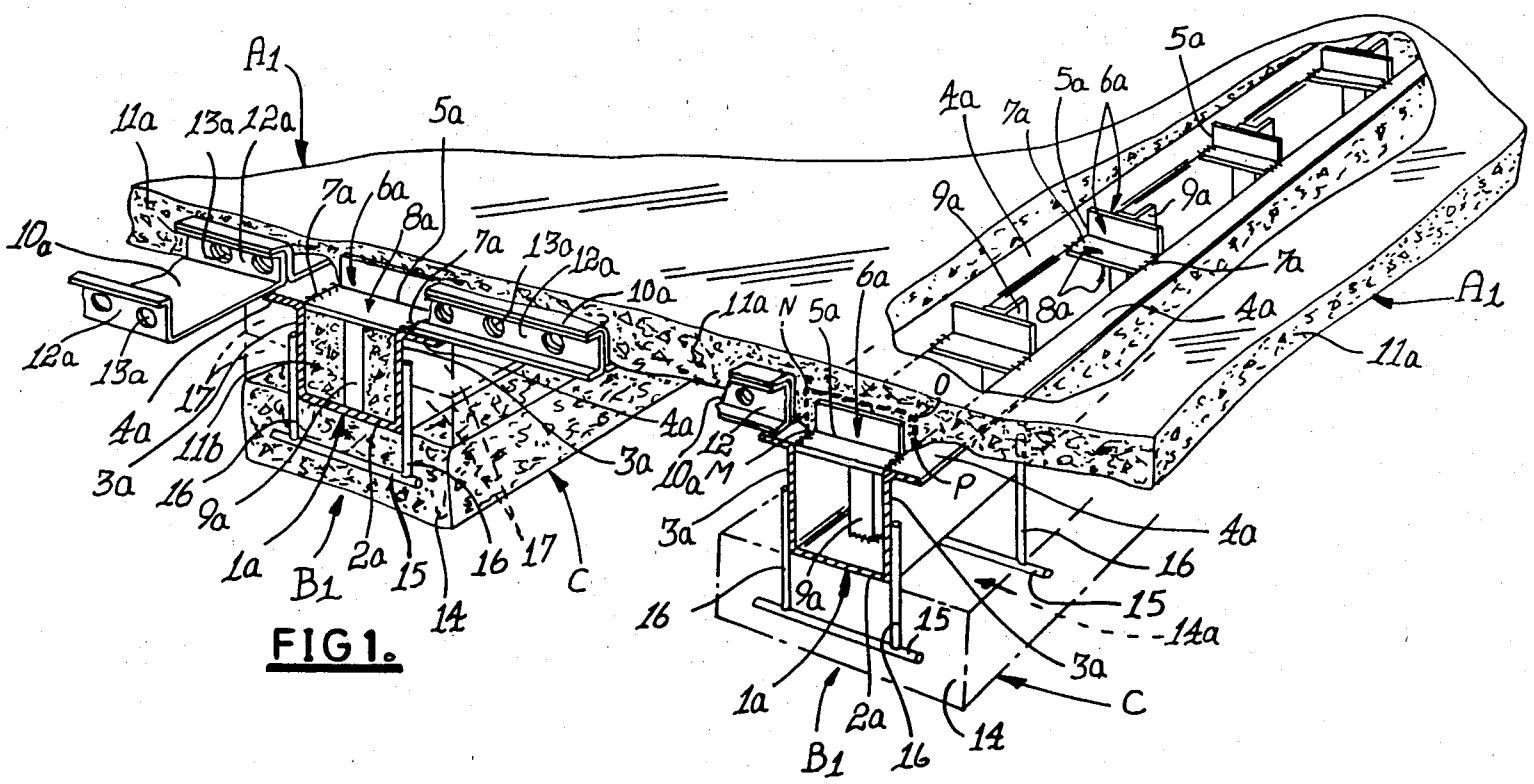
Figure 2:
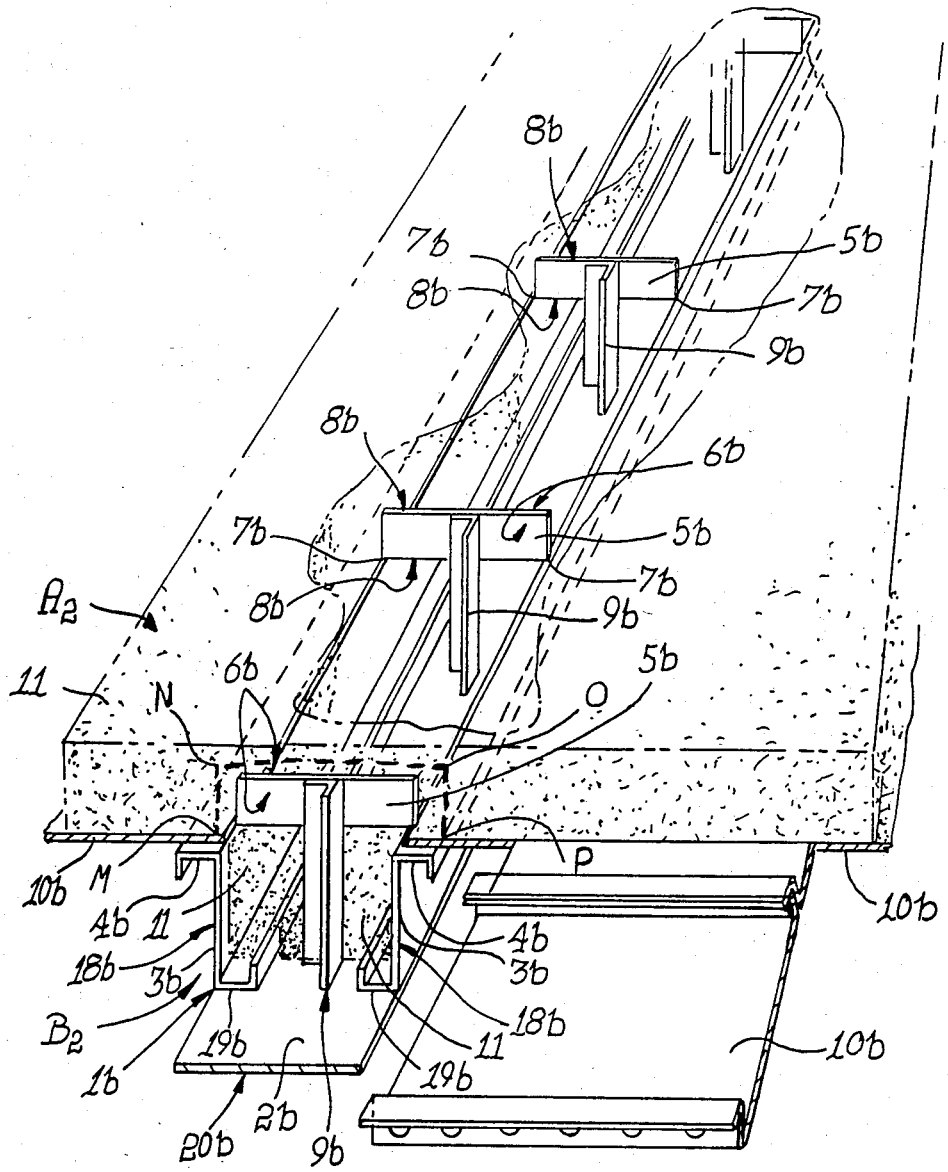
Figure 3:
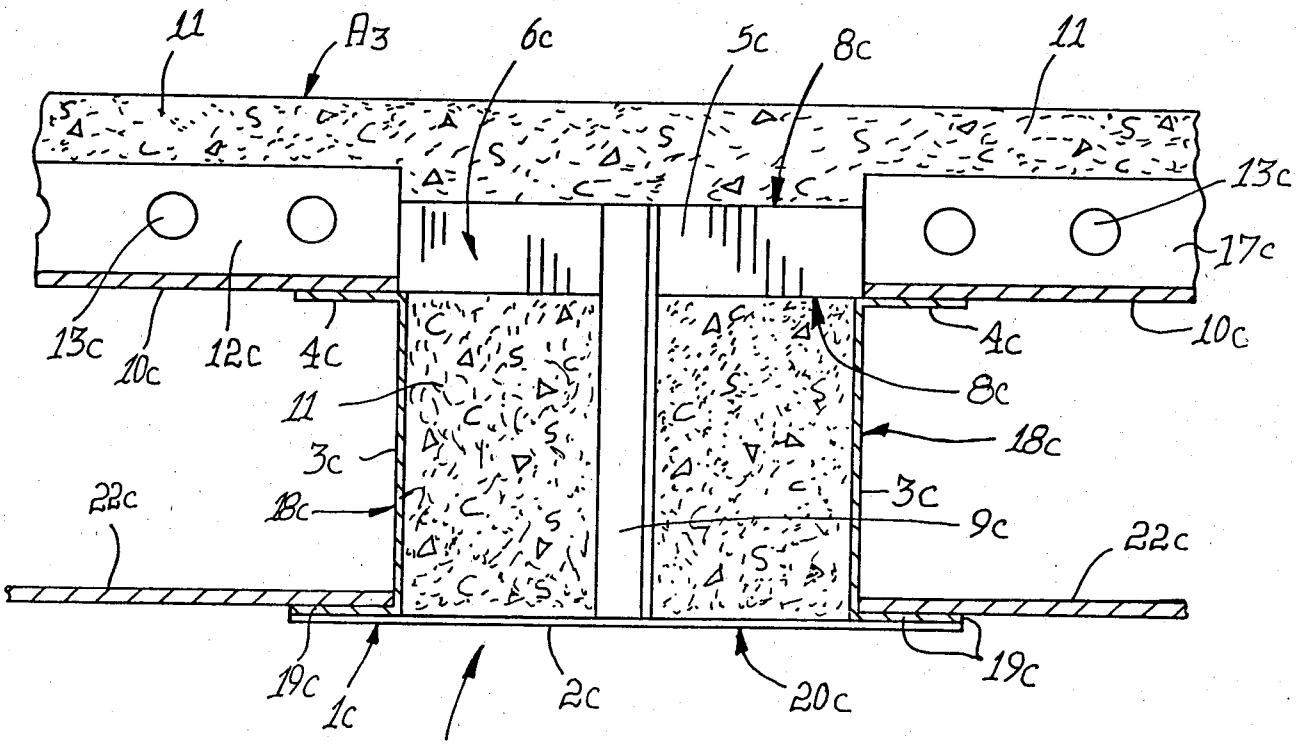
FIG. 3 is a diagrammatic cross-sectional view of part of a composite reinforced floor structure according to the invention, illustrating yet another embodiment of permanent beam shuttering according to the invention.

Referring first to FIG. 1, the composite floor structure comprises reinforced concrete floor slab Al which is integrally formed with a plurality of transversely spaced, horizontally disposed, reinforced concrete beams B1.

Each beam B1 comprises permanent shuttering comprising an elongate, open-mouthed and upwardly facing channel-shaped member 1*a* of integral construction which is made of steel. Channel member 1*a* defines a bottom web 2*a*, a pair of transversely spaced and upright main flanges 3*a* extending along opposite sides of web 2*a* and outwardly directed secondary flanges 4*a* at the upper ends of upright flanges 3*a*. Channel member 1*a* is suitably supported in horizontal disposition in positions spaced apart along its length.

A plurality of steel transverse members 5*a* of angle section are spaced apart along the length of channel member 1*a* and extend transversely to channel member 1*a* across the entire width of the open mouth of the channel member. Each transverse member 5*a* is fast with channel member 1*a* in the region of its mouth on opposite sides of the mouth. As shown in FIG. 1, the one flange of each transverse member 5*a* is disposed substantially vertically and extends upwardly from the mouth of channel member 1*a* across the entire width of the mouth of the channel formation, the vertically disposed flange presenting side surfaces 6*a* on opposite sides thereof which face horizontally in a direction longitudinally along channel member 1*a*. The other flange of each transverse member 5*a* is disposed substantially horizontally and is welded at opposite ends thereof to channel member 1*a* at 7*a*, on opposite sides of the channel member, each horizontally disposed flange presenting surfaces 8*a* on opposite sides thereof which face vertically.

Each transverse member 5*a* is provided with an elongate steel upright member 9*a* of angle section which is located centrally between the upright main flanges 3*a* of channel member 1*a* and extends upwardly from the bottom web 2*a* of channel member 1*a* to the transverse member 5*a* in question. Each upright member 9*a* is welded at opposite ends thereof to its transverse member 5*a* and to the bottom web 2*a* of channel member 1*a*.

A plurality of interengageable metal shuttering pans or panels 10*a* of any suitable design are located side by side between each pair of beams B1 so that the opposite ends of the shuttering pans 10*a* rest on the outwardly directed secondary flanges 4*a* of the opposed upright main flanges 3*a* of the channel members 1*a* of the pair of adjacent beams B1.

Concrete is poured into the shuttering pans 10*a* and into the channel members 1*a* of the beams B1 round transverse members 5*a* and upright members 9*a* to form the reinforced concrete floor slab A1 and the reinforced concrete beams B1. Concrete can pass from shuttering pans 10*a* into the channel members 1*a* of beams B1 through the spaces between the spaced apart transverse members 5*a* so that the channel members 1*a* are completely filled with concrete and the concrete 11 of floor slab A1 is integral with the concrete 11 of beams B1. The upright members 9*a* of each beam B1 are encased in concrete 11 of the beam. The horizontally disposed flanges of the transverse members 5*a* of each beam B1 are encased in the concrete 11 of the floor slab A1 and of the beam B1. The vertically disposed flanges of the transverse members 5*a* of each beam B1 are encased in the concrete 11 of floor slab A1, the upper edges of the vertically disposed flanges being covered by a layer of concrete.

The shuttering pans 10*a* include flanged sides 12*a* which are embedded in the concrete 11 of floor slab A1. The sides 12*a* of shuttering pans 10*a* are provided with registering apertures 13*a* therethrough to provide integral connection between the concrete in adjacent pans 10*a*.

It will be appreciated that channel members 1*a* and shuttering pans 10*a* constitute shuttering into which the wet concrete is poured to form floor slab A1 and integral beams B1. The channel members 1*a* and shuttering pans 10*a* should have sufficient "wet strength" to support on their own or with a minimum of external temporary support, the load of wet concrete until such time as the concrete hardens. Thereafter, the steel channel members 1*a* and their steel transverse members 5*a* and steel upright members 9*a*, as well as the steel shuttering pans 10*a*, constitute permanent reinforcement for the composite structure. At least part of the steel constitutes the permanent tension resistant component of the composite structure and the hardened concrete constitutes the permanent compression resistant component of the composite structure.

In each beam B1, the transverse members 5*a* act as brace members which connect together the upright main flanges 3*a* of the channel member 1*a* to retain the upright main flanges 3*a* against outward displacement when wet concrete is poured into the channel member 1*a*. The transverse members 5*a*, aided by the upright members 9*a*, also stiffen the construction of the channel member 1*a* to resist twisting and bending when wet concrete is poured into the channel member 1*a*. In the completed floor structure after the concrete has hardened, this resistance to twisting and bending of the channel members 1*a* renders the composite floor structure resistant to torsion and bending under loading.

The transverse members 5*a* also act to improve integration of the metal and concrete components. The horizontally disposed flanges of the transverse members 5*a* act as hold-down means to resist vertical separation of the metal and concrete components. The vertically disposed flanges of the transverse members 5*a* act as shear-resisting means to resist relative horizontal movement between the steel and the concrete. Each transverse member 5*a* presents vertically disposed, horizontally facing, concrete engaging surfaces 6*a* of relatively large surface area. Each transverse member 5*a* is anchored in the concrete within a potential horizontal shear plane which is of the type indicated by the dotted lines MNOP at the beam B1 on the right hand side of FIG. 1 and which is of extended length. Enhanced shear resistance may be obtained.

It will be appreciated that the flanges of the upright members 9*a* which face in two mutually perpendicular directions assist to resist relative horizontal movement between the steel and the concrete in a direction longitudinally along the beams B1 before failure occurs along shear plane MNOP and also act to resist relative ber 1*d*. The upright members 9*d* of each transverse member 5*d* are located against the inner surfaces of the upright main flanges 3*d* of channel member 1*d* and are secured thereto, such as by welding. Each upright member 9*d* is secured towards its upper end to its transverse member 5*d*, such as by means of welding. The transverse members 5*d* are of angle section and are welded at opposite ends thereof to the upright main flanges 3*d* of channel member 1*d* at 7*d* on opposite sides of the open mouth of the channel formation.

The arrangements of FIGS. 1 to 4 are suitable for relatively narrow beams. For wider beams the arrangement of FIG. 5 may be used.

Figure 4:
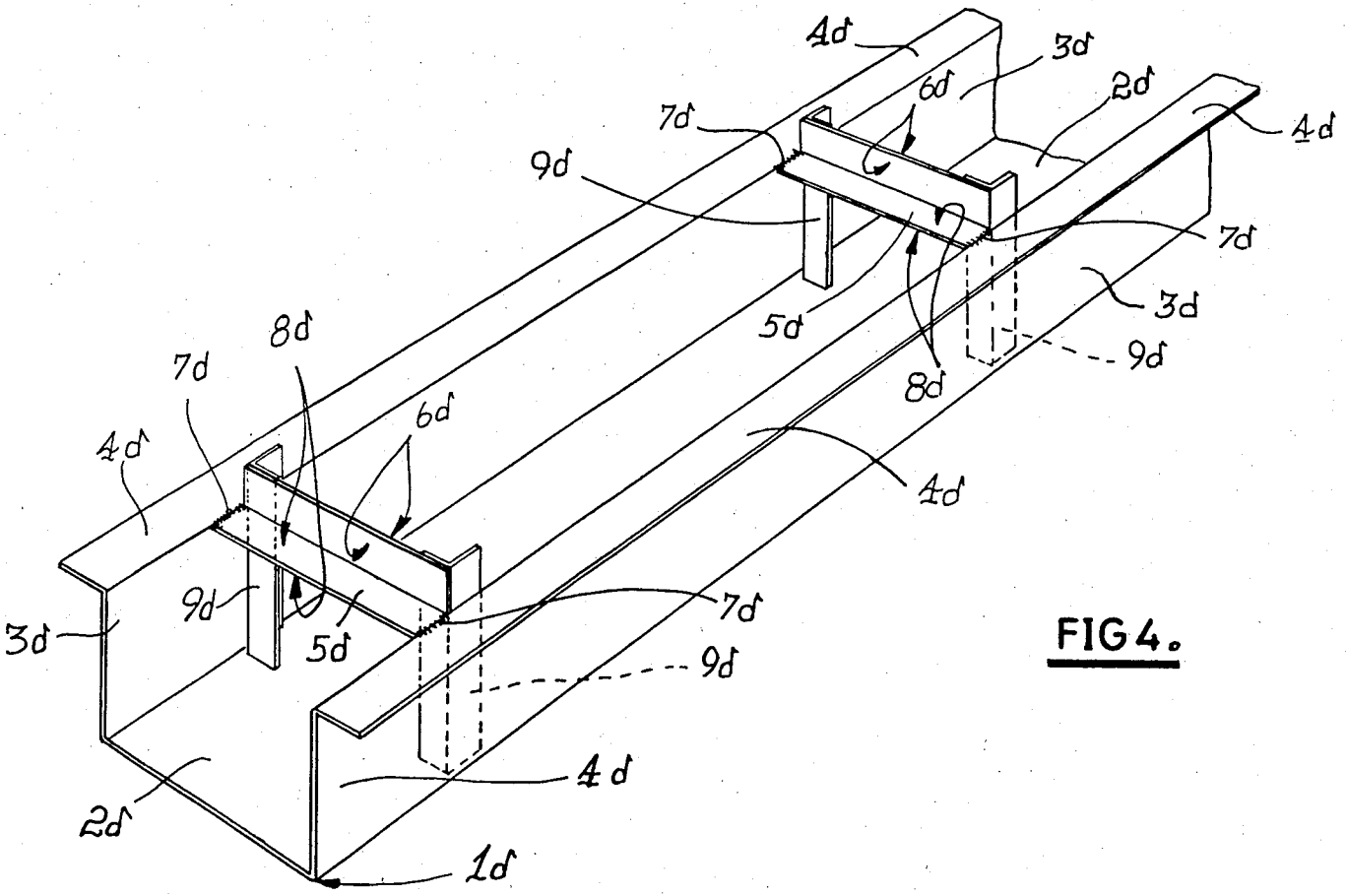
FIGS. 4 and 5 are perspective views of further embodiments of permanent beam shuttering according to the invention.
Figure 5:
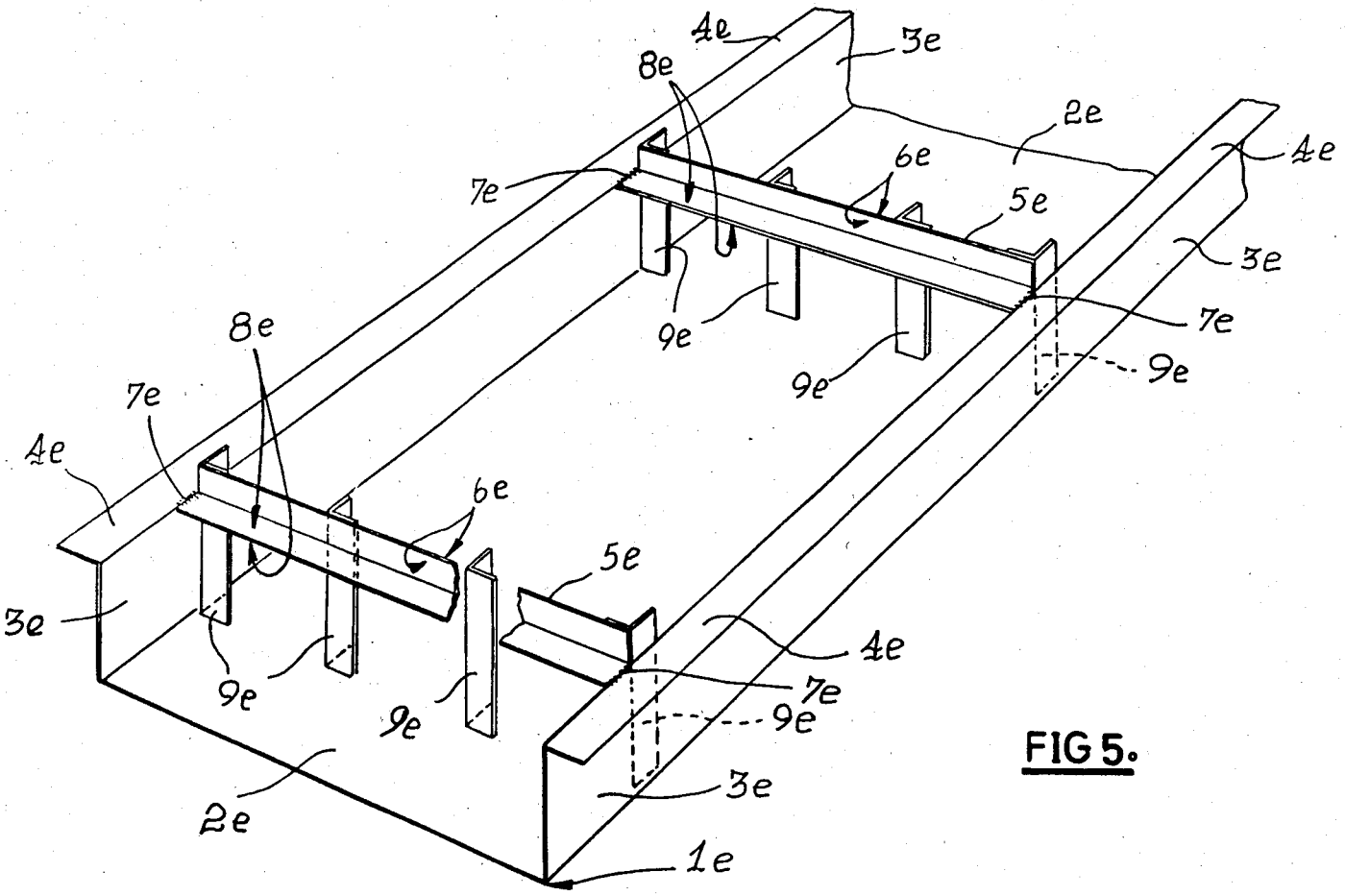

The arrangement of FIG. 5 is similar to that of FIG. 4 with the exception that the channel member 1*e* of FIG. 5 is wider than channel member 1*d* of FIG. 4 and each transverse member 5*e* of FIG. 5 is provided with a set of four elongate upright members 9*e* which extend upwardly from web 2*e* of channel member 1*e* and which are spaced apart transversely to the length of channel member 1*e*. The outer upright members 9*e* of each set are located against the inner surfaces of the upright main flanges 3*e* of channel member 1*e* and are secured thereto, such as by welding. The two inner upright members 9*e* of each set are secured at opposite ends thereof, such as by means of welding, to the bottom web 2*e* of channel member 1*e* and to their transverse member 5*e*.

It will be appreciated that many other variations in detail are possible without departing from the scope of the appended claims. For example, normal nominal reinforcement, such as round or profiled or deformed steel bars and/or high tensile steel welded wire mesh, may be added to the structure in order to prevent or minimize cracking of the compression resistant material where negative moments may force it to accommodate tension and also to absorb shrinkage and/or temperature variations of the compression resistant material.

Instead of the channel member of the beam shuttering having outwardly directed secondary flanges for supporting floor shuttering means, the channel member may be provided with inwardly directed flanges which are spaced apart to present an open-mouthed channel formation.

The Applicant believes that one or more of the following advantages may be obtained with a composite metal reinforced concrete floor structure according to the invention:

(a) A relatively simple and/or quick and/or cheap construction requiring a minimum of skilled labour may be obtained.

(b) A relatively light construction method placing minimum loading on a support structure may be possible so that a lighter supporting structure may be used.

(c) Temporary props and shuttering may be dispensed with altogether or may be reduced to a minimum.

(d) An improved integration of the metal and concrete components may be obtained.

(e) The metal structure may be made more rigid and its rigidity may be increased to permit longer spans with a given quantity of metal.

(f) A smaller overall depth of a floor slab and beam combination may be obtained to provide space saving.

(g) The provision of fire protection for the metal may be facilitated.

(h) All material in the structure may be functional from a structural point of view.

(i) The metal structure may be produced from standard sections which are commercially available.

It will be appreciated that instead of each transverse member 5 of the channel member 1 of beam shuttering according to the invention being provided with one or more upright members 9, only certain of the transverse members 5 may be provided with one or more upright members 9.

Also, instead of each transverse member 5 extending outwardly as a whole or having a part thereof extending outwardly from the mouth of the channel member 1, only certain of the transverse members 5 may extend outwardly or have parts which extend outwardly from the mouth of the channel member 1.

What is claimed is:

1. A composite floor structure comprising a floor slab of compression resistant material; and at least one reinforced beam under the floor slab, the beam comprising:

permanent shuttering including an upwardly facing channel formation having an open-mouth portion and constructed of tension resistant material; and a plurality of transverse members spaced apart along a length of the channel formation and extending transversely to the channel formation across substantially an entire width of the open-mouth portion of the channel formation, each transverse member being fast with the channel formation near said open-mouth portion on opposite sides thereof and at least a part of at least some of the transverse members extending upwardly from the open-mouth portion of the channel formation into the overlying floor slab;

compression resistant material located in the channel formation and formed integrally with the compression resistant material of the floor slab; and at least one upright member connected to at least some of said transverse members and extending within said channel formation from a connection with a bottom web thereof.

2. A composite floor structure as claimed in claim 1, wherein each transverse member comprises an angle section presenting a pair of flanges disposed transversely to each other, the one flange presenting substantially horizontally disposed, vertically facing concrete engaging surfaces and the other flange presenting substantially vertically disposed, horizontally facing concrete engaging surfaces.

3. A composite floor structure as claimed in claim 1 or claim 2, including fire protective means for the tension resistant material of the beam.

4. A composite floor structure as claimed in claim 1, wherein each of at least some of the transverse members is provided with a set of at least two upright members which are spaced apart transversely to the channel formation.

5. A composite floor structure as claimed in claim 1 or 4, wherein the upright members comprise angle sections.

6. A composite floor structure as claimed in claim 1 or claim 2, wherein the channel formation is adapted to support shuttering means for the floor slab.

7. A composite floor structure as claimed in claim 6, wherein upright sides of the channel formation are provided towards upper-ends with transverse formations adapted to support floor shuttering means.

8. A composite floor structure as claimed in claim 1 or claim 2, including permanent shuttering for the floor slab.

9. A composite floor structure as claimed in claim 1 or claim 2, wherein the channel formation is adapted to support an edge of a ceiling panel.

10. A composite floor structure as claimed in claim 9, wherein the channel formation is provided towards the bottom web thereof with an outwardly directed ceiling panel supporting formation.

* * * * *